US006793316B2

(12) United States Patent
Sugimura et al.

(10) Patent No.: US 6,793,316 B2
(45) Date of Patent: Sep. 21, 2004

(54) INK JET RECORDING APPARATUS AND RECOVERING METHOD THEREOF

(75) Inventors: Hideo Sugimura, Tokyo (JP); Tetsuya Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/081,843

(22) Filed: Feb. 25, 2002

(65) Prior Publication Data

US 2002/0126177 A1 Sep. 12, 2002

(30) Foreign Application Priority Data

Feb. 28, 2001 (JP) ..... 2001-054587

(51) Int. Cl.[7] ..... B41J 2/165

(52) U.S. Cl. ..... 347/29; 347/23; 347/33; 347/30; 347/32

(58) Field of Search ..... 347/29, 30, 22, 347/23, 25, 33, 14

(56) References Cited

U.S. PATENT DOCUMENTS 5,831,644 A * 11/1998 Kato ..... 347/22

* cited by examiner

*Primary Examiner*—Shih-Wen Hsieh
(74) *Attorney, Agent, or Firm*—Fitzpatrick, Cella, Harper & Scinto

(57) ABSTRACT

An ink jet recording device is provided comprising a head recovering unit for operating for recovering a discharge function of an ink jet recording head, a cap member disposed on the head recovering unit to tightly close ink discharge ports, a recording medium conveying mechanism for conveying a recording medium, and a connecting unit for switching transmission and non-transmission of a driving force to the head recovering unit in conjunction with a capping operation of the cap member, and makes it possible to provide a drive switching mechanism which is convenient and highly reliable, reduce a number of driving source and realize a recording apparatus having a high reliability at a low cost while saving a space.

7 Claims, 10 Drawing Sheets

INK JET RECORDING APPARATUS AND RECOVERING METHOD THEREOF

BACKGROUND OF THE INVENTION

1. Field of the Invention

The present invention relates to an ink jet recording apparatus to be applied to image processing apparatuses such as a copying machine, a printer, and a facsimile, and a recovering method for the ink jet recording apparatus.

2. Related Background Art

There are conventionally available recording apparatuses for recording images on recording media in various recording modes, for example, a wire dot mode, a temperature-sensing mode, a heat transfer mode and an ink jet mode. Among these recording apparatuses, an ink jet recording apparatus records an image on a recording medium by discharging fine ink droplets from fine discharge ports of an ink jet recording head, and generally has a head recovering unit including wiping means for removing contaminant from a surface of the ink jet recording head on which nozzles are arranged and sucking means for exhausting ink and bubbles from the nozzles.

The ink jet recording apparatus is generally of a serial type recording apparatus which reciprocally scans an ink jet recording head in a direction intersecting or perpendicular to a conveying direction of a recording sheet.

An example of such a conventional serial type ink jet recording apparatus is shown in FIG. 14. This ink jet recording apparatus has a recording head 102, recording head conveying means, recording medium conveying means and a head recovering unit 101.

Though the recording head 102 is not described in detail, this head is a unit which is used for recording data by discharging ink from nozzles to a recording medium (not shown) utilizing heat energy produced by driven electro-thermal converting elements and mechanical oscillating energy of piezo elements, and mounts ink tanks 103 and 104. This recording head 102 is mounted on a carriage 105. The carriage 105 is reciprocally movable in a width direction of the recording medium by an operation of the recording head conveying means. The recording medium (for example, recording sheet) on which data is to be recorded by the ink jet recording apparatus is set in a sheet feeding tray 109, fed by a sheet feeding roller 110 to a recording portion for recording, and further conveyed by a conveying roller 107 and pinch rollers 108. The recording medium conveying means is a mechanism which includes the conveying roller 107 and the pinch rollers 108.

A head recovering unit 101 is disposed outside a recording range of the recording head 102. This head recovering unit 101 includes wiping means for removing contaminant from a surface of the recording head on which nozzles are disposed, sucking means for exhausting ink, bubbles and the like out of the nozzles of the recording head. In this ink jet recording apparatus, ink is discharged from the recording head 102 while scanning with the carriage 105 in a condition where the recording medium is conveyed to the recording portion and the recording medium is conveyed at a predetermined pitch each time a cycle of scanning is completed. The scanning with the carriage 105, the discharge of ink from the recording head 102 and the conveyance of the recording medium at the predetermined pitch are carried out alternately to record data on the recording medium.

Such a conventional ink jet recording apparatus requires independent driving mechanisms for the recording head conveying means which moves the carriage 105, the recording medium conveying means which moves the recording medium and the recording head recovering unit 101 which operates the sucking means and the like respectively, thereby having exclusive driving sources such as motors. Furthermore, a driving mechanism for feeding the recording medium to the recording portion may be separate from a driving mechanism for conveying the recording medium in the recording portion and a sheet discharge portion downstream the recording portion, and these driving mechanisms may have driving sources respectively. Furthermore, cap means for close sealing a nozzle surface of the recording head 102 and the sucking means may be driven by independent driving mechanisms and driving sources respectively which are separate from each other. Since a conventional ordinary ink jet recording apparatus has independent driving mechanisms for various use and includes a large number of driving sources as described above, the apparatus is large as a whole and requires a high manufacturing cost.

In order to reduce a manufacturing cost, a certain ink jet recording apparatus utilizes a force for driving recording medium conveying means as a driving force of a recovering operation. This apparatus connects a driving source of the recording medium conveying means to a driven portion (for example, sucking means) of a head revering unit through a drive switching clutch at a timing for a recovering operation. This drive switching clutch is configured to operate in conjunction with a movement of a carriage mounting a recording head and connect the driving source of the recording medium conveying means to the head recovering unit, for example, when the carriage reaches a home position outside a recording range. However, this configuration imposes a heavy lead on the carriage during the movement and forces the carriage to have rather a surplus moving distance for operating the clutch, thereby resulting in enlargement of a width of the apparatus as a whole.

Furthermore, there is an ink jet recording apparatus of the so-called full line type which uses a fixed long linear head having a nozzle row substantially equal or longer to or than a width of a recording medium and does not require a carriage or a carriage moving mechanism. This full line type ink jet recording apparatus does not use recording head conveying means, but has recording medium conveying means for moving a recording medium and a recording head recovering unit for operating a sucking mechanism and the like, which have independent driving mechanisms respectively and requires driving sources for these mechanisms respectively. This full line type ink jet recording apparatus does not move a recording head and cannot adopt the above described configuration which switches a drive switching clutch in conjunction with a movement of a carriage.

SUMMARY OF THE INVENTION

An object of the present invention is to provide an ink jet recording apparatus which is applicable as both the serial type and the full line type, reduce a required number of driving sources, permits saving a space and has a high reliability as well as a recovering method for the apparatus.

Another object of the present invention is to provide an ink jet recording apparatus comprising a head recovering unit for recovering a discharge function of an ink jet recording head, a cap member disposed on the head recovering unit to tightly close ink discharge ports, a recording medium conveying mechanism for conveying a recording medium, and a connecting unit for switching transmission and non-transmission of a driving force to the head recovering unit in conjunction with a capping operation of the cap member.

DETAILED DESCRIPTION OF THE PREFERRED EMBODIMENTS

Description will be made below of the preferred embodiment of the present invention with reference to the accompanying drawings.

Figure 1:
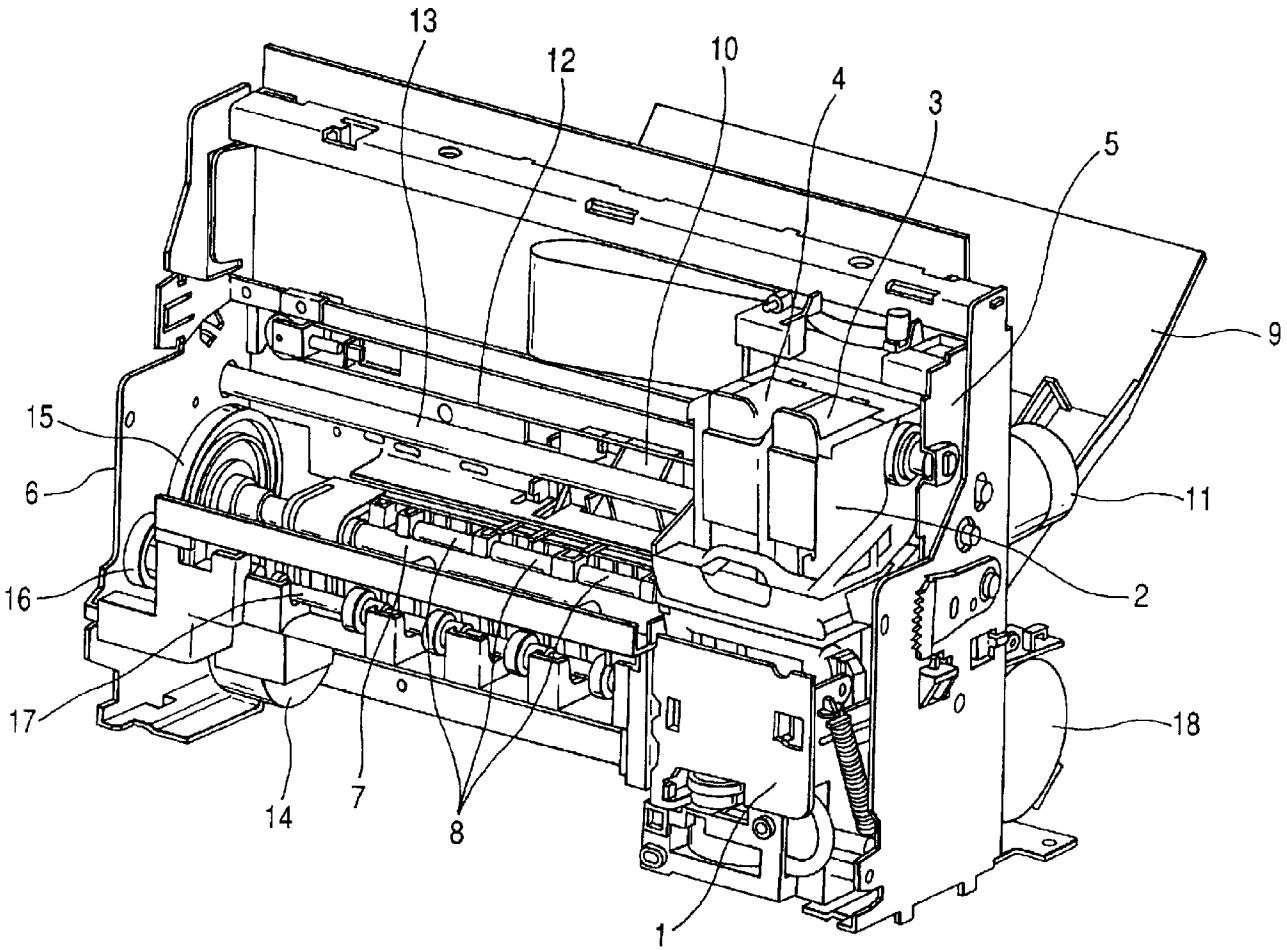
FIG. 1 is a perspective view of an ink jet recording apparatus according to an embodiment of the present invention.

FIG. 1 is a perspective view of an ink jet recording apparatus according to an embodiment of the present invention. This ink jet recording apparatus is of the serial type which reciprocates a carriage mounting an ink jet recording head, and has recording head conveying means for mounting and moving a recording head 2, recording medium conveying means, a head recovering unit 1 and the like.

First, description will be made of the recording head 2 and the recording head conveying means.

The recording head 2 has a plurality of nozzles formed on a surface opposed to a recording medium (not shown), receives an electric signal from an electric circuit (not shown) and produces heat energy by selectively driving electrothermal converting elements which are disposed in flow paths in the recording head 2. The recording head 2 is a unit for recording characters, images and the like by heating and bubbling ink with the heat energy, and discharging the ink from the nozzles to the recording medium utilizing a bubbling pressure so as to adhere the ink to the recording medium. The recording head 2 is mounted on a carriage 5 in a condition where ink tanks 3 and 4 are mounted on the recording head 2.

By an operation of the recording head conveying means, a carriage 5 is reciprocally movable in a width direction of the recording medium. The carriage 5 is supported by a carriage shaft 13 so as to be movable in an axial direction (left-right direction in FIG. 1) and a carriage belt 12 which is wound around a pulley (not shown) coupled with a carriage motor 11 is fixed to the carriage 5. Accordingly, the carriage belt 12 circulates and the carriage 5 moves along the carriage shaft 13 when the carriage motor 11 operates. Since the recording head 2 is connected to the electric circuit (not shown) through a flexible circuit board, a signal can be transmitted free from an influence due to the movement of the carriage 5.

Recording media (not shown; for example, recording sheets) on which data is to be recorded by the recording apparatus are set in a sheet feeding tray 9 and fed one by one with a sheet feeding roller 10. This sheet feeding roller 10 is driven by an AP (auto-sheet feeder/purge) motor 18 which supplies a driving force for sheet feeding and a driving force for head recovering function described later. A configuration of this sheet feeding mechanism will be detailed later.

The recording medium which is fed with the sheet feeding roller 10 is conveyed with a conveying roller 7 and pinch rollers 8, and discharged with a sheet output roller 17. The conveying roller 7 is driven with an LF (line feed) motor 14 through an LF train 15, whereas the sheet output roller 17 is driven with the LF motor 14 through a sheet output gear train 16.

Figure 3:
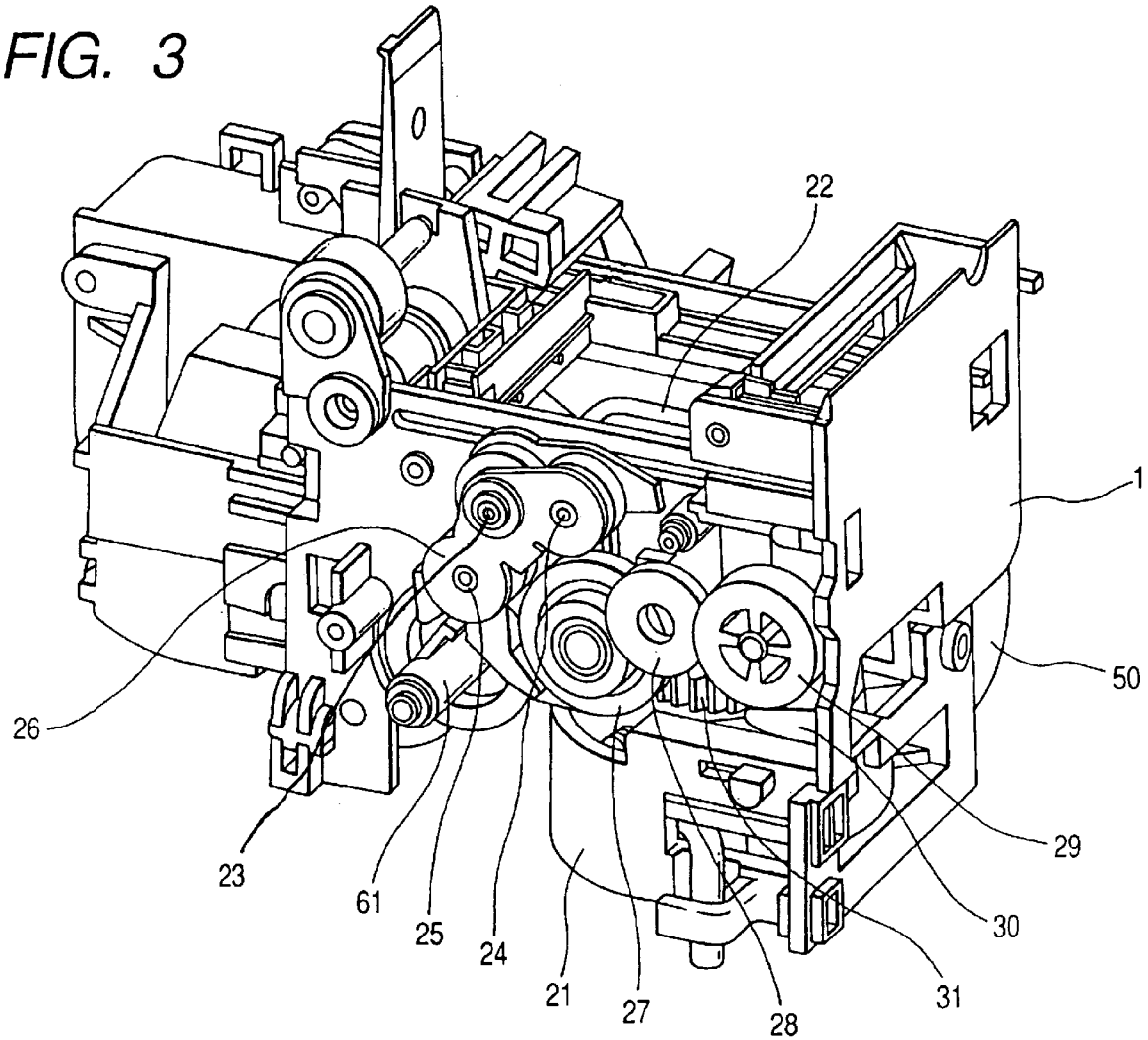
FIG. 3 is a partially omitted perspective view of the head recovering unit.
Figure 4:
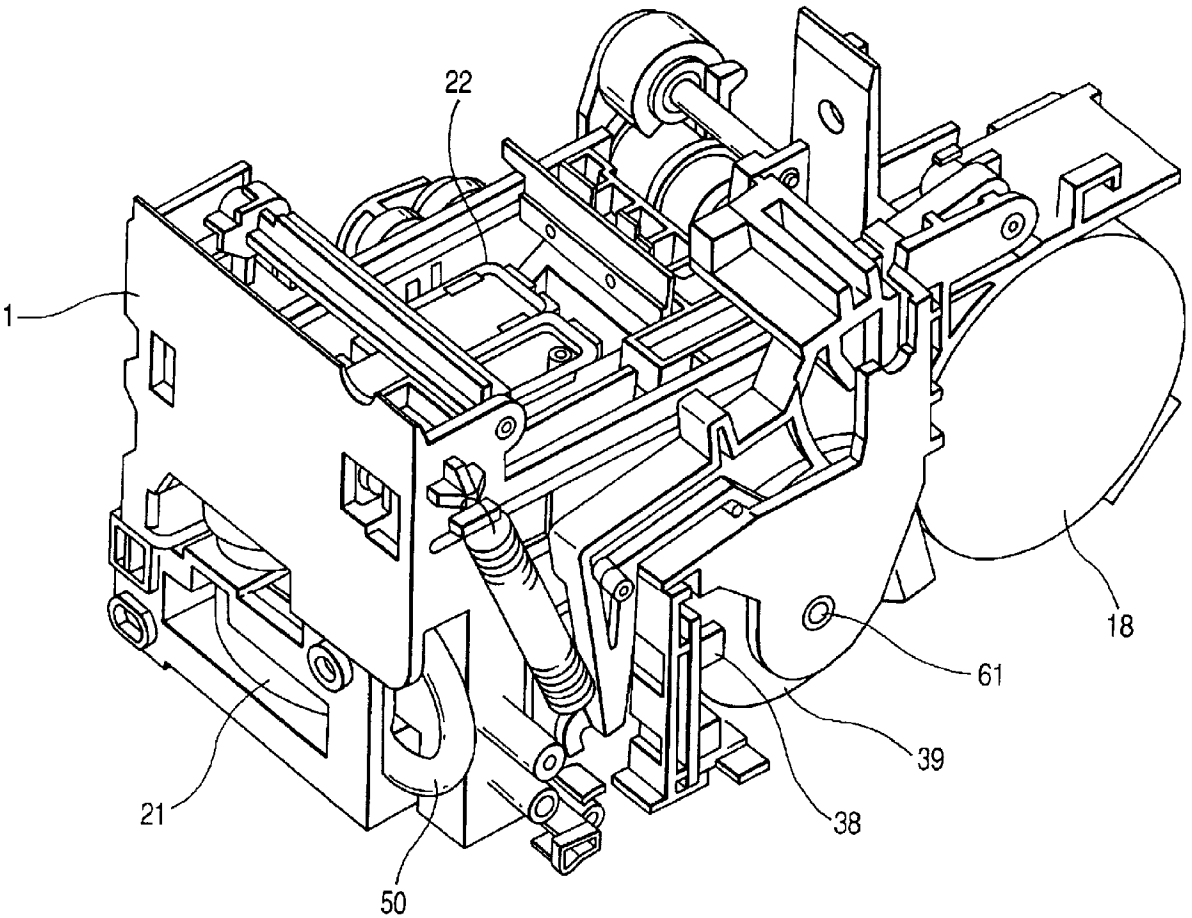
FIG. 4 is a perspective view of the head recovering unit as seen in a direction different from a direction in FIG. 3.

The head recovering unit 1 is disposed outside a recording range within which recording is carried out on the recording medium by the recording head 2. This head recovering unit 1 is shown in FIGS. 3 and 4 in a condition where a pump gear bracket 56 for supporting each gear is omitted for easy understanding of a configuration. Though not detailed here, the head recovering unit 1 includes wiping means for removing contaminant from the recording head 2, sucking means (a sucking mechanism) 21 for exhausting ink and bubbles and the like from nozzles of the recording head 2.

Figure 5:
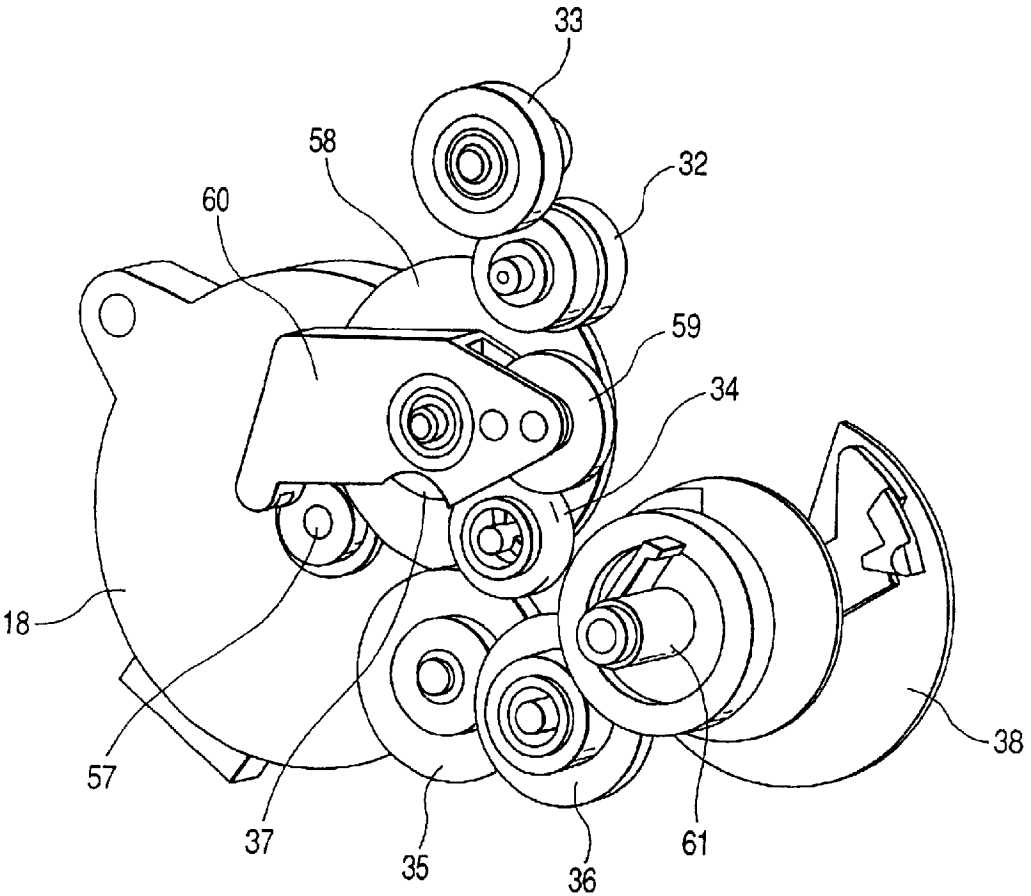
FIG. 5 is a perspective view of a driving force transmission system for an AP motor.

Now, description will be made again in detail of the sheet feeding mechanism which feeds the recording medium to the recording portion (an area where recording on the recording medium is carried out by the ink jet recording head 2). A driving source for this sheet feeding mechanism is an AP motor 18 shown in FIG. 1 and rotations of this AP motor 18 are transmitted to the sheet feeding roller 10 as a driving force for feeding the recording medium. Referring to FIG. 5 and the like, specific description will be made of a mechanism for transmitting this driving force, mainly of a configuration of a gear train of this mechanism.

A motor pinion 57 attached to a driving shaft of the AP motor 18 is coupled with a pendulum input gear 58. The pendulum input gear 58 is coaxial with a pendulum sun gear 37 and rotates together with the pendulum sun gear 37 which is coupled with a pendulum planet gear 59. The pendulum planet gear 59 is rotatably supported by a pendulum holder 60 which is coaxial with the pendulum sun gear 37 and can oscillate with pendulum planet gear 59 being held. When the AP motor 18 rotates in a normal direction, the pendulum planet gear 59 is coupled with a sheet feeding idle gear 32, which is coupled with a sheet input gear 20 shown in FIG. 2 through a sheet output gear 33 (a coupled condition not shown). A sheet feeding gear train (not shown) couples the sheet input gear 20 with the sheet feeding roller 10 (see FIG. 1). When the AP motor 18 rotates in the normal direction, the sheet feeding roller 10 is coupled with the AP motor 18 through the sheet input gear 20 and the like as described above, thereby being capable of feeding the recording medium.

When the AP motor 18 rotates in a reverse direction, on the other hand, the above described pendulum planet gear 59 is coupled with a pendulum idle gear 34. This pendulum idle gear 34 is coupled with a main cam 61 through a pendulum reduction gear 35 and a pendulum reduction gear 36.

Figure 6:
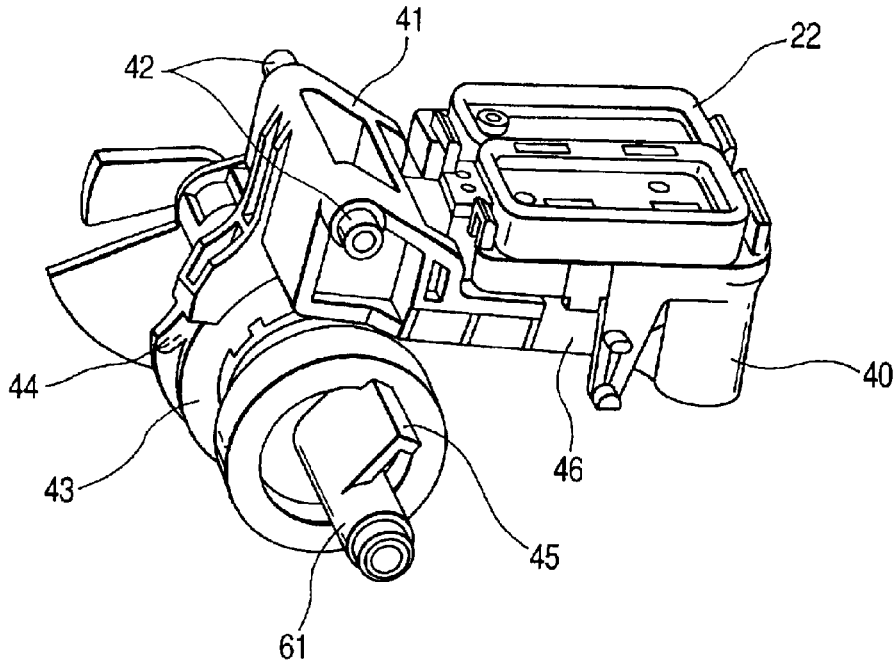
FIG. 6 is a perspective view showing a condition where a suction cap is lowered.
Figure 7:
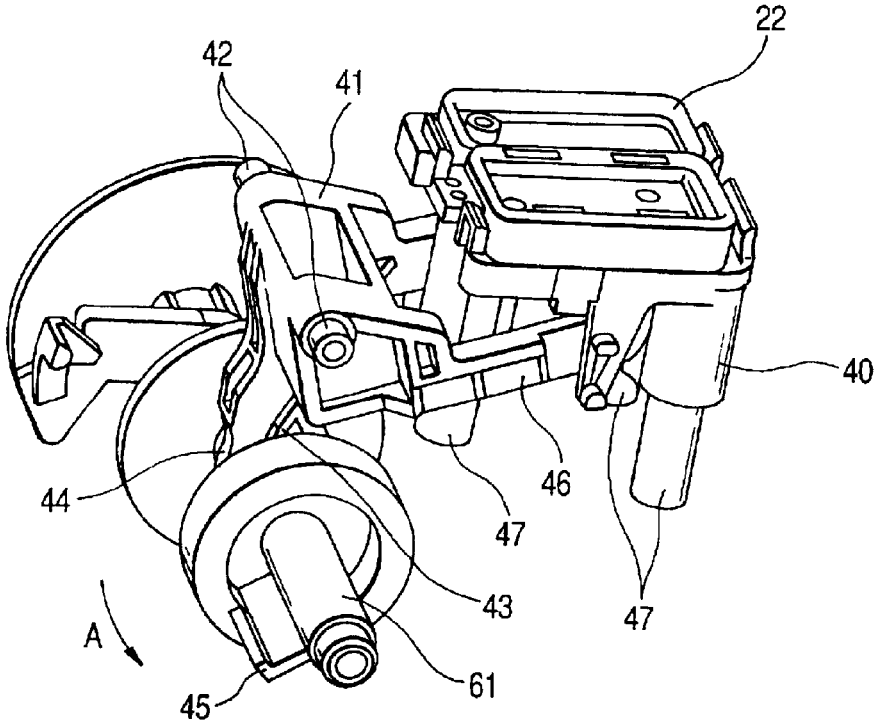
FIG. 7 is a perspective view showing a condition where the suction cap is raised.
Figure 8:
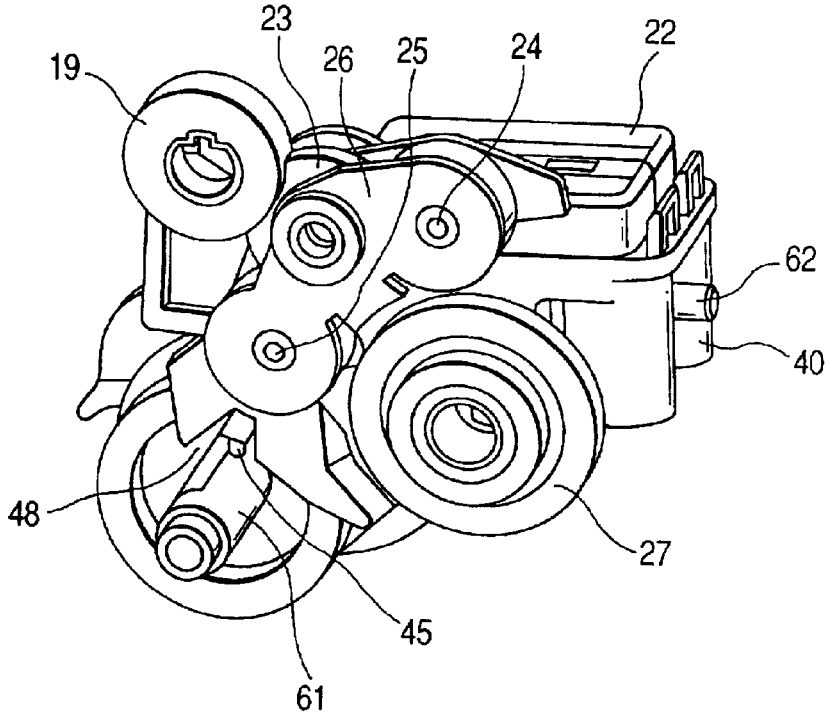
FIG. 8 is a perspective view showing a relation between a main cam and a pump planet gear in the condition where the cap is lowered.

A mechanism for moving cap means 22 up and down is shown in FIGS. 6 and 7. A cap cam 43 is formed integrally with the main cam 61 as shown in FIG. 6. This cap cam 43 is kept in contact with a cap cam follower portion 44 of a cap lever 41. The cap lever 41 can swing around a swinging shaft 42 and an arm 46 of the cap lever 41 is engaged with a cap base 40 which holds a suction cap (cap means) 22. In addition, the cap base 40 is urged upward by a cap spring 47 (see FIG. 7). The driving force transmission mechanism which is configured as described above allows the AP motor 18 to move the suction cap 22 up and down through the main cam 61 and the like when the AP motor rotates in the reverse direction.

In this embodiment, a mechanical clutch mechanism is disposed in the vicinity of the head recovering unit 1 as connecting means (a connecting unit) shown in FIG. 3. This mechanical clutch mechanism consists of a pump sun gear 23, a pump planet gear 24, a pump planet gear 25 and a pump planet arm 26 which is a holding member for rotatably supporting these gears and can swing around the pump sun gear 23.

Now, description will be made of sucking means 21 and a peripheral mechanism of this means in this embodiment, mainly of a configuration of a gear train.

Disposed in the head recovering unit 1 is the sucking means 21 for sucking ink out of the recording head 2 through the above described suction cap 22. Description will be made first of a configuration for driving the sucking means 21.

Figure 2:
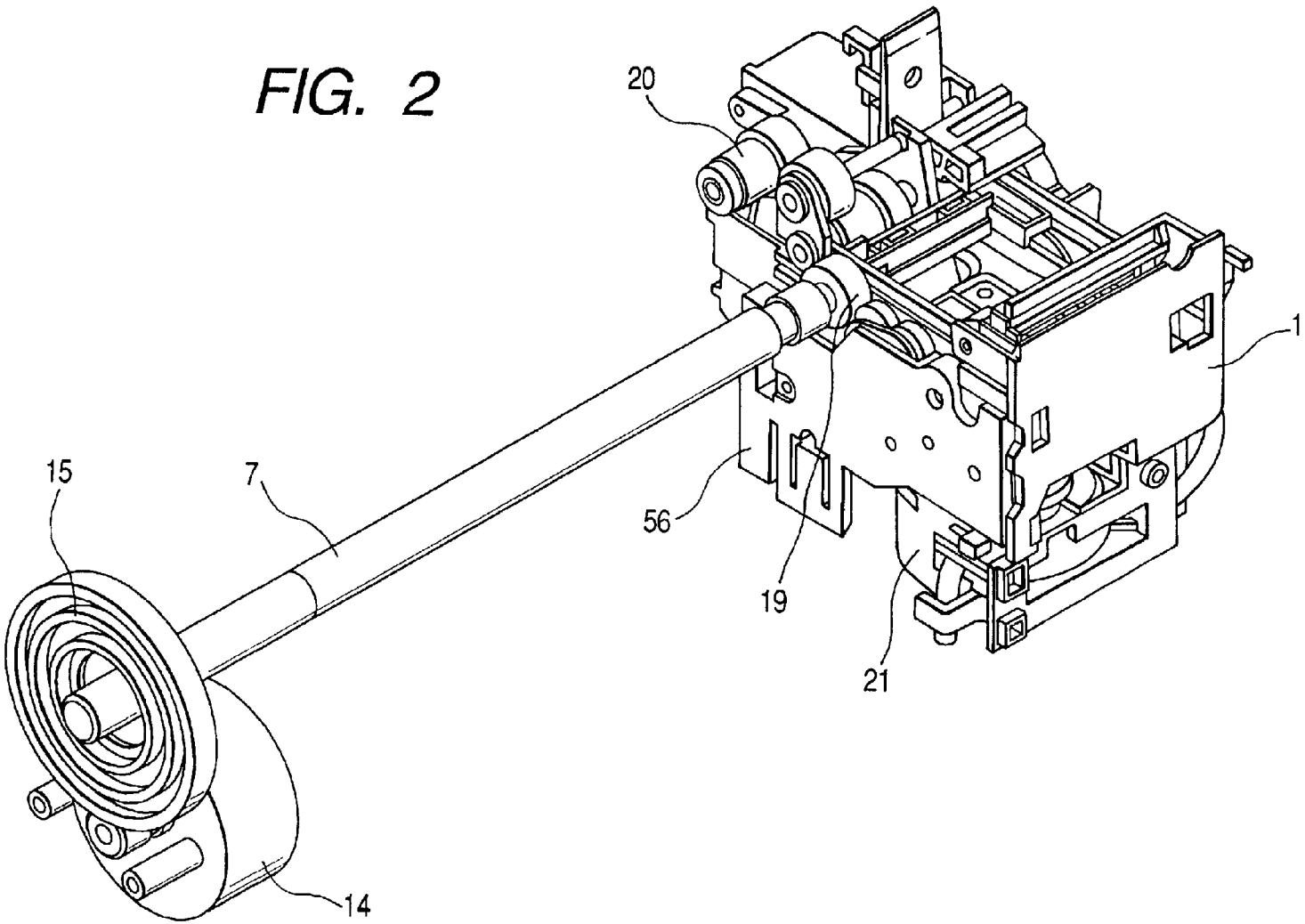
FIG. 2 is a perspective view of a driving force input/output system for a head recovering unit.

The LF motor 14 is coupled with the conveying roller 7 through the LF gear train 15 as shown in FIG. 2 and the pump input gear 19 is disposed rotatably together with the conveying roller 7. Coupled with this pump input gear 19 is the pump sun gear 23 of the clutch mechanism shown in FIGS. 3 and 9 to 11. Either the pump planet gear A24 or the pump planet gear 25 can selectively be coupled with a pump reduction gear 27.

Figure 10:
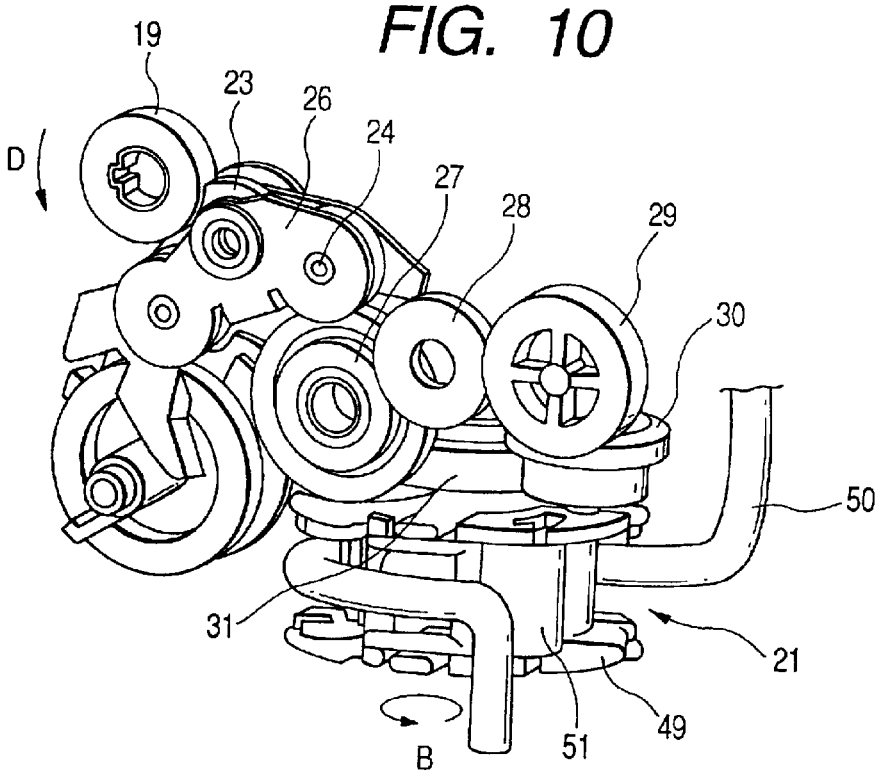
FIG. 10 is a perspective view of a configuration for transmitting a driving force in a condition where a suction pump is operating.
Figure 11:
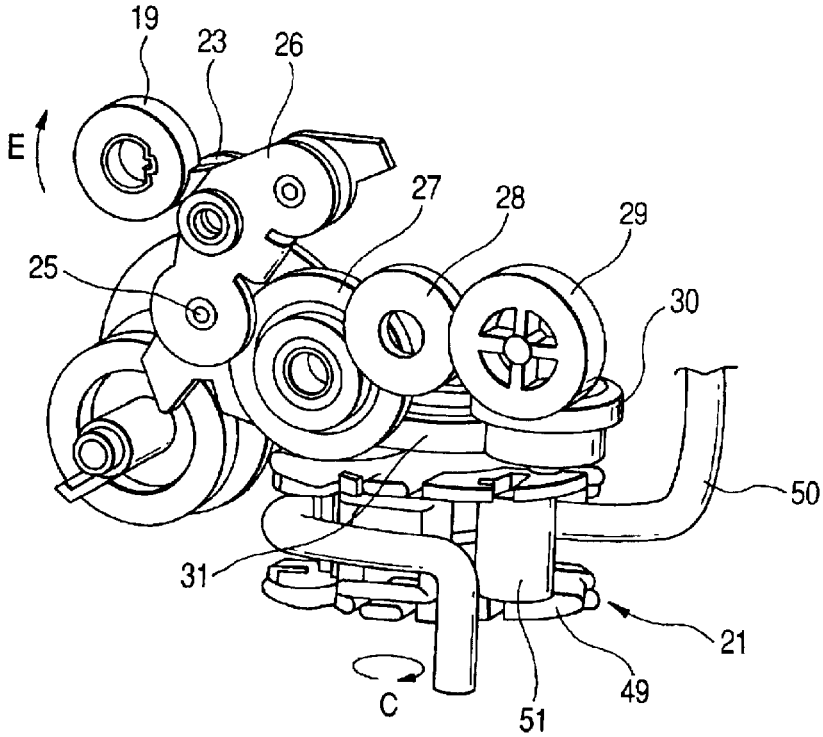
FIG. 11 is a perspective view of a configuration for transmitting the driving force in a condition where the suction pump is not operating.

The pump reduction gear 27 is coupled with a pump idler gear 28 and further with a pump gear 31 through a pump bevel gear 29 and a pump bevel gear 30 as shown in FIG. 10. The pump gear 31 can rotate together with a pump operating member 49 in the suction pump (sucking means) 21.

Figure 12:
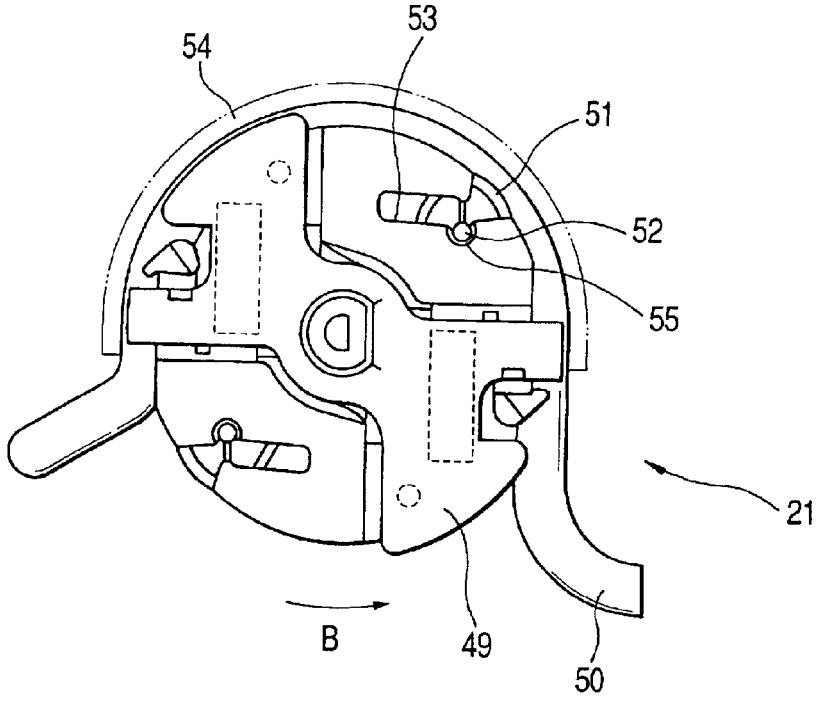
FIG. 12 is an enlarged view showing an operating condition of the suction pump.

When the pump planet gear 24 is coupled with the pump reduction gear 27, the pump operating member 49 is interlocked with the pump gear 31 as shown in FIG. 12 and rotated in a direction indicated by an arrow B. At this time, pump rollers 51 which are disposed at two locations with a phase difference of 180 degrees are shifted outward a pump radius due to frictional resistance of a suction tube 50, a pump roller shaft portion 52 moves from a shunt slit portion 53 to a roller bearing portion 55 and the pump roller 51 squeezes the suction tube 50 in cooperation with a tube clamp portion 54 of a main body of the head recovering means 1, thereby performing a sucking operation. When the pump operating member 49 is driven to rotate in the normal direction, the suction tube 50 is squeezed by the pump roller 51, whereby a negative pressure is produced in the suction tube 50 and a sucking force is generated by the suction pump 21. Since the suction tube 50 is communicated with the suction cap 22 through a suction tube joint 62 which is formed integrally with the cap base 40, the suction tube 50 sucks the contaminant owing to the negative pressure which is produced in the suction cap 22 when the sucking force is generated.

Figure 13:
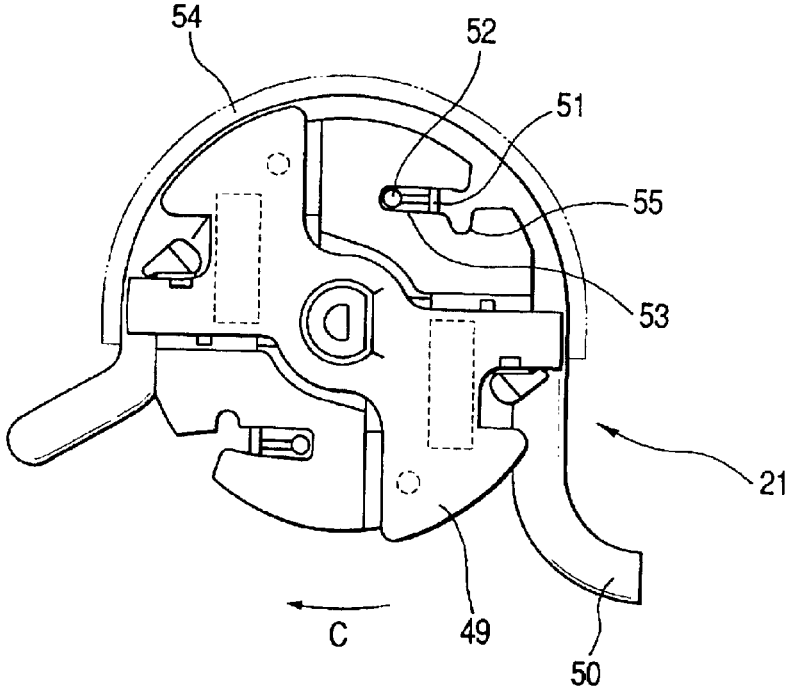
FIG. 13 is an enlarged view showing an inoperative condition of the suction pump.
Figure 14:
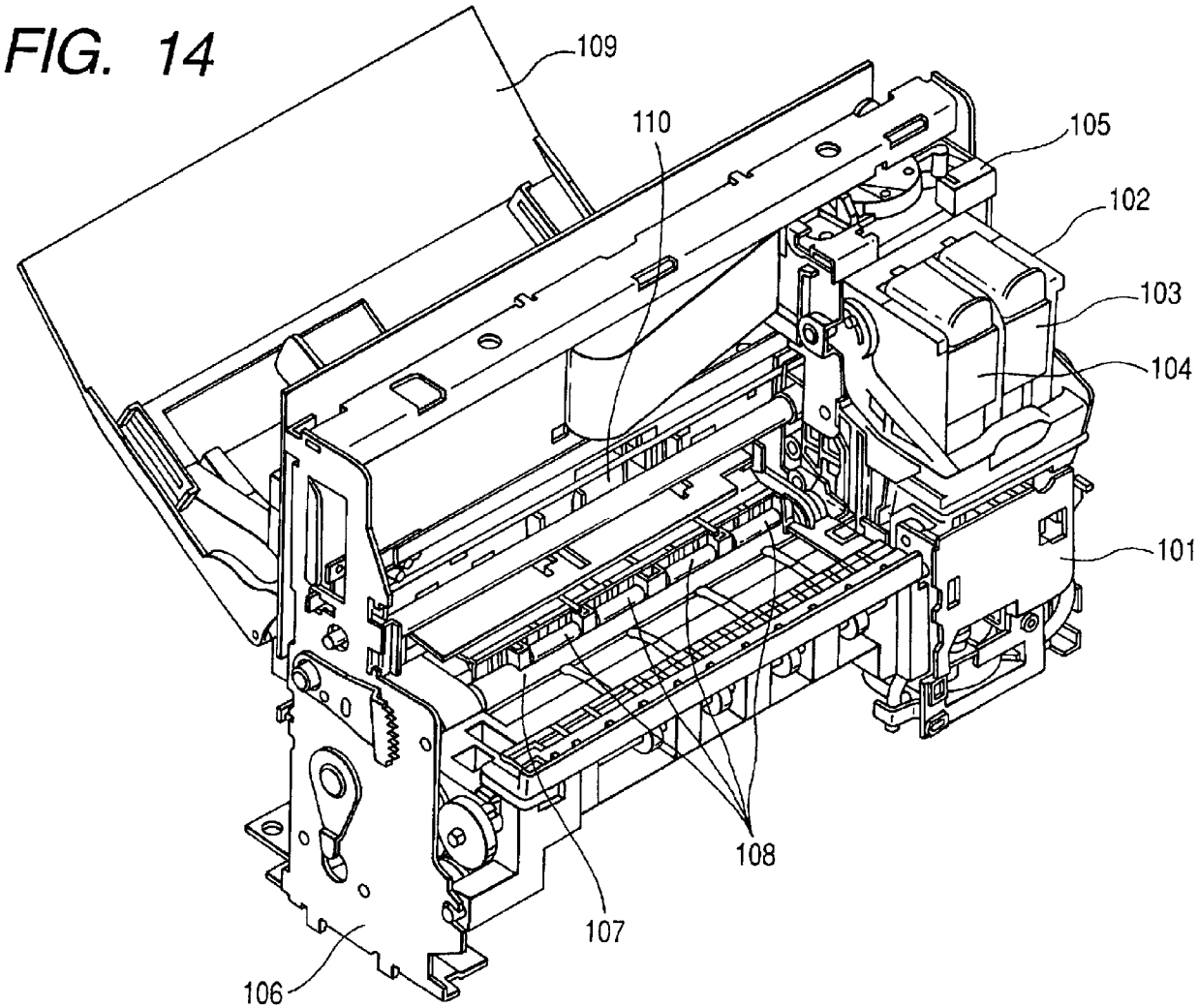
FIG. 14 is a perspective view of a conventional ink jet recording apparatus.

When the pump planet gear 25 is coupled with the pump reduction gear 27, in contrast, the pump operating member 49 is interlocked with the pump gear 31 as shown in FIG. 13 and rotated in a direction indicated by an arrow C. Then, the pump roller 51 is shifted inward direction the pump radius due to the frictional resistance of the suction tube 50 and the pump roller shaft portion 52 is located at the shunt slit portion 53, whereby the pump roller 51 does not squeeze the suction pump 50 and does not generated the sucking force for the sucking pump 21. When the pump operating member 49 is rotated reversely in the direction indicated by the arrow C as described above, the pump roller 51 retreats in a direction away from the suction tube 50, thereby releasing the suction tube 50 from a squeezed condition. In other words, an interior of the suction cap is open to atmosphere without the sucking force to be generated.

In addition, a main cam sensor 38 which uses a transmission type of a photo sensor is disposed at a location at which the main cam sensor can oppose to a shielding portion 59 of the main cam 61 as shown in FIG. 4.

The above described motors, sensors and the like are connected to a control circuit (not shown).

Description will be made of operations of the ink jet recording apparatus having the above described configuration according to the embodiment.

Describing recording operations of this ink jet recording apparatus, the AP motor 18 rotates first in the normal direction, thereby rotating the motor pinion 57, the pendulum input gear 58 and the pendulum sun gear 37, and coupling the pendulum planet gear 59 with the sheet feeding idle gear 32 shown in FIG. 5. Rotations of the pendulum planet gear 59 are transmitted to the sheet feeding roller 10 through the sheet feeding gear 32, the sheet output gear 33, the sheet input gear 20 (see FIG. 2) and a sheet feeding gear (not shown), thereby rotating the sheet feeding roller 10. Accordingly, the recording medium (not shown) set in the sheet feeding tray 9 is fed toward the recording portion.

In a condition where the recording medium is conveyed to the recording portion by the sheet feeding roller 10, the recording head 2 receives a signal from the electric circuit (not shown) and discharges the ink while scanning with the carriage 5 driven with the carriage motor 11 and the carriage belt 12. Each time a single cycle of scanning completes, the recording medium is conveyed by a predetermined pitch by the conveying roller 7 and the pinch rollers 8 which are driven by the LF motor 14 and the LF gear train 15. Data is recorded on the recording medium by alternately carrying out the scanning with the carriage 5, the ink discharge from the recording head 2 and the conveyance of the recording medium by the predetermined pitch. After the recording is completed, the recording medium is discharged by the sheet discharge roller 17 which is driven by the LF motor 14 and the sheet discharge gear train 16.

In a condition where the recording operation can be carried out, the suction cap 22 is lowered as shown in FIG. 6. In this condition, a planet lock cam 45 which is formed integrally with the main cam 61 is engaged with an engaging notch portion 48 of the pump planet arm 26. Therefore, the pump planet arm 26 does not swing even if the pump input gear 19 which is to rotate together with the conveying roller 7 rotates, whereby the pump planet gear 24 and the pump planet gear 25 are not coupled with the pump reduction gear 27. Accordingly, the pump gear 31 and the pump operating member 49 which are coupled with the pump reduction gear 27 as described above do not rotate, whereby the suction pump 21 does not operate. That is, rotations of the conveying roller 7 does not cause the sucking operation during the recording operation.

In the ink jet recording apparatus a condition where it does not carry out recording, the recording head 2 moves to the home position, that is, a location opposed to the head recovering unit 1. With the recording head 2 set at this location, a capping operation which is an operation to bring the cap means 22 into close contact with the nozzle surface is carried out for protecting the nozzle surface and preventing ink from being dried and set in the nozzles. A concrete method for the capping operation is as described below.

Figure 9:
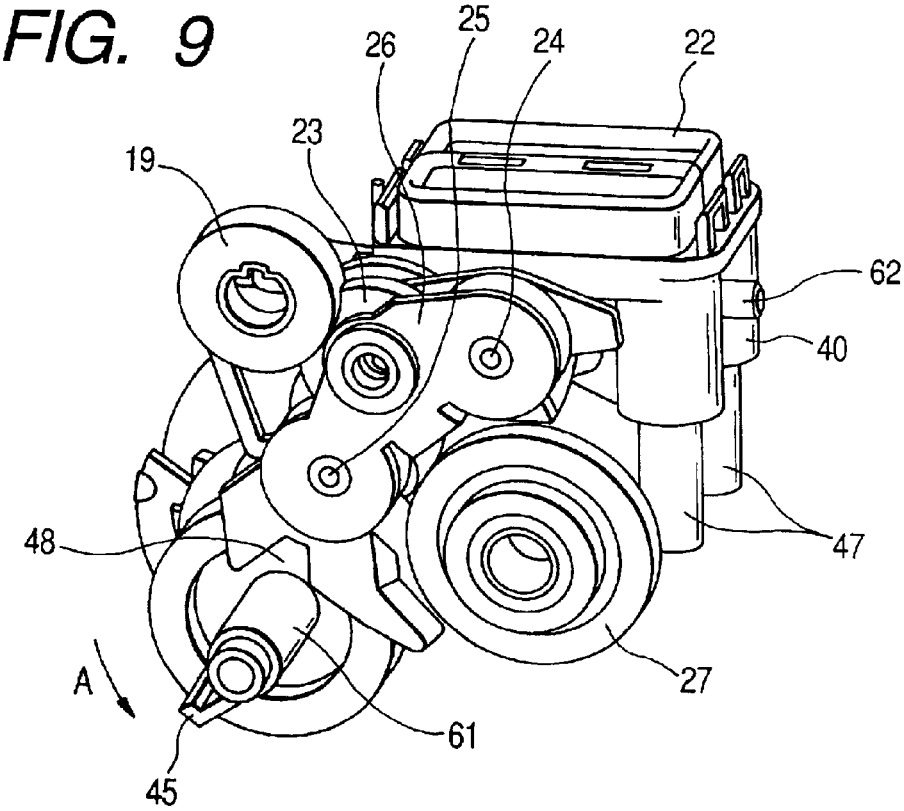
FIG. 9 is a perspective view showing a relation between the main cam and the pump planet gear in the condition where the cap is raised.

During the capping operation, the AP motor 18 rotates in the reverse direction, thereby rotating the motor pinion 57, the pendulum input gear 58 and the pendulum sun gear 37, and coupling the pendulum planet gear 59 with the pendulum idle gear 34. This pendulum idle gear 34 is coupled with the main cam 61 through the pendulum reduction gear 35 and the pendulum reduction gear 36. Accordingly, the main cam 61 rotates in a direction indicated by an arrow A as shown in FIG. 9 and the planet lock cam 45 comes out of the engaging notch portion 48 of the pump planet arm 26.

Simultaneously, a cap cam 43 which is formed integrally with the main cam 61 rotates as the main cam 61 rotates leaves from a position for pushing up the cap cam follower portion 44 of the cap lever 41, the cap base 40 is pushed up by the cap spring 47 and the cap means 22 is brought into close contact with the nozzle surface of the recording head 2 to tightly close the nozzles.

When the LF motor 14 rotates in the normal direction in this condition, the conveying roller 7 and the pump input gear 19 are rotated in a normal direction indicated by an arrow D through the LF gear train 15 (see FIG. 10). At this time, the main cam 61 rotates as the capping operation proceeds as described above and the planet lock cam 45 has come out of the notch portion 48 of the pump planet arm 26 as shown in FIG. 9, whereby the pump planet gear 24 is coupled with the pump reduction gear 27. The pump gear 31 and the pump operating member 49 rotates in the direction indicated by the arrow B in conjection with the pump reduction gear 27 rotates (see FIGS. 10 and 12), the suction tube 50 is squeezed by the pump roller 51, the negative pressure is produced in the suction tube 50 and the suction pump 21 generates the sucking force. Accordingly, the ink, bubbles and the like are sucked and exhausted out of the recording head 2 through the cap means 22 in close contact with the nozzle surface as described above.

The ink jet recording apparatus is configured to transmit the driving force to the suction pump 21 only after the main cam 61 rotates as the capping operation proceeds and the planet lock cam 45 has come out of the notch portion 48 of the planet arm 26 as described above. When the capping operation is not carried out, the planet lock cam 45 is kept in a locked condition where the lock cam is engaged with the notch portion 48 of the pump planet arm 26, whereby the driving force is not transmitted to the suction pump 21 and the sucking operation can not be carried out.

When the LF motor 14 rotates in the reverse direction, on the other hand, the conveying roller 7 and the pump input gear 19 are rotated in the reverse direction through the LF gear train 16. Since the planet lock cam 45 has come out of the notch portion 48 of the pump planet arm 26 as the capping operation proceeds, the pump planet gear 25 is coupled with the pump reduction gear 27. As the pump reduction gear 27 rotates, the pump gear 31 and the pump operating member 49 rotate in the direction indicated by the arrow C (see FIGS. 11 and 13). At this time, the suction tube 50 is not squeezed by the pump roller 51, the negative pressure is not produced in the suction tube 50 and the sucking force is not generated by the suction pump 21. That is, the sucking force is not generated and the interior of the suction cap is open to atmosphere.

When the conveying roller 7 rotates in the reverse direction and the pump input gear 19 rotates in a direction indicated by an arrow E (see FIG. 11) as described above, the pump operating member 49 is driven to rotate reversely in a direction indicated by an arrow C (see FIGS. 11 and 13) and the pump roller 51 retreats in a direction away from the suction tube 50, thereby releasing the suction tube 50 from the squeezed condition. In other words, the suction pump 21 does not generate the sucking force and the interior of the suction cap 22 opens to atmosphere.

The ink jet recording apparatus according to the embodiment is capable of selecting whether or not the suction pump 21 is to carry out the sucking operation dependently on the rotation of the LF motor 14 in the normal or reverse direction.

Furthermore, whether or not the planet lock cam 45 is engaged with the engaging notch portion 48 of the pump planet arm 26 is a factor to determine whether or not the suction pump 21 can operate and the planet lock cam 45 comes out of the engaging notch portion 48 as the main cam 61 rotates. The ink jet recording apparatus is capable of detecting a phase of the main cam 61 with the main cam sensor 38 which uses the transmission type photosensor shown in FIG. 4 and controlling whether or not the suction pump 21 can operate according to a phase detection result, thereby being capable of managing an operating timing of the suction pump 21 with a high accuracy.

In addition, the present invention is effective for all ink jet recording apparatuses which require tightly closing surfaces of the ink jet recording apparatuses on which nozzles are disposed and ink discharge performance recovering processings. Furthermore, the present invention is effective not only for the serial type which reciprocates a carriage mounting a recording head but also the full line type which uses a fixed long head having a nozzle row substantially equal or longer to or than a total width of a recording medium.

The embodiment makes it possible not only to provide a drive switching mechanism which is convenient and highly reliable but also reduce the number of driving sources and realize a highly reliable recording apparatus at a low cost while saving a space. Moreover, the configuration according to the embodiment exhibits effect for recording apparatuses of both the serial type and the full line type.

What is claimed is:

1. An ink jet recording apparatus for recording data by discharging ink from ink discharge ports of an ink jet recording head, said apparatus comprising:

a cap member movable between a first position for closely contacting a nozzle surface of said ink jet recording head and a second position apart from said nozzle surface;

a first driving source for generating a driving force to move said cap member between said first and second positions;

a suction source for sucking ink of said ink jet recording head through said cap member;

a second driving source for generating a driving force to drive said suction source; and an engaging portion, engageable with and disengageable from the driving force of said second driving source, for transmitting the driving force of said second driving source to said suction source when said cap member is at said first position and not transmitting the driving force of said second driving source to said suction source when said cap member is at said second position.

2. An ink jet recording apparatus according to claim 1, wherein said second driving source supplies a driving force to a conveying mechanism for conveying a recording medium.

3. An ink jet recording apparatus according to claim 1, wherein said engaging portion is a mechanical clutch mechanism.

4. An ink jet recording apparatus according to claim 3, wherein said engaging portion includes, a sun gear, a planetary gear connected to the sun gear, and a gear holding member for holding the sun gear and the planetary gear and engageable with a driving force of said first driving source.

5. An ink jet recording apparatus according to claim 1, further comprising a carriage for mounting said ink jet recording head, and a third driving source for generating a driving force to drive said carriage.

6. An ink jet recording apparatus according to claim 1, wherein said first driving source drives a sheet supplying mechanism for supplying a recording medium.

7. An ink jet recording apparatus according to claim 1, wherein said ink jet recording head discharges ink from the ink discharge ports utilizing heat energy generated by electrothermal converting elements.

* * * * *

UNITED STATES PATENT AND TRADEMARK OFFICE

CERTIFICATE OF CORRECTION

PATENT NO. : 6,793,316 B2
DATED : September 21, 2004
INVENTOR(S) : Sugimura et al.

It is certified that error appears in the above-identified patent and that said Letters Patent is hereby corrected as shown below:

Title page,
Item [57], ABSTRACT,
Line 2, “for operating” should be deleted.
Line 11, “source” should read -- sources --.

Column 2,
Line 16, “use” should read -- uses --.
Line 24, “revering” should read -- recovering --.
Line 48, “above” should read -- above --.

Column 3,
Line 23, “raised:” should read -- raised; --.

Column 5,
Lines 2 and 32, “above described” should read -- above-described --.
Line 40, “gear A24” should read -- gear 24 --.

Column 6,
Line 9, “direction” should read -- in the direction of --.
Line 13, “generated” should read -- generate --.
Line 20, “to be” should read -- being --.
Line 22, “a” (first occurrence) should be deleted.
Lines 25 and 28, “above described” should read -- above-described --.

Column 7,
Line 5,”does” should read -- do --.
Line 26, “a” should read -- as a --, and “43” should read -- 43, --.
Line 27, “rotates” (first occurrence) should read -- rotates and --, and “rotates” (second occurrence) should read -- rotates, --.
Line 42, “rotates” should read -- rotate --.
Line 43, “conjection” should read -- conjunction --.
Line 44, “rotates” should read -- rotation --.
Line 60, “can not” should read -- cannot --.

UNITED STATES PATENT AND TRADEMARK OFFICE

CERTIFICATE OF CORRECTION

PATENT NO. : 6,793,316 B2
DATED : September 21, 2004
INVENTOR(S) : Sugimura et al.

It is certified that error appears in the above-identified patent and that said Letters Patent is hereby corrected as shown below:

Column 8,
Line 49, "a" should be deleted.

Signed and Sealed this

Seventeenth Day of May, 2005

JON W. DUDAS
*Director of the United States Patent and Trademark Office*